US005689794A

United States Patent [19]

Kondo

[11] Patent Number: 5,689,794

[45] Date of Patent: Nov. 18, 1997

[54] PAPER TRANSPORT MECHANISM FOR USE IN AN IMAGE FORMING APPARATUS

[75] Inventor: Akihiro Kondo, Osaka, Japan

[73] Assignee: Mita Industrial Co., Ltd., Osaka-fu, Japan

[21] Appl. No.: 607,410

[22] Filed: Feb. 28, 1996

[30] Foreign Application Priority Data

Mar. 3, 1995 [JP] Japan ..... 7-044434

[51] Int. Cl.[6] ..... G03G 15/00

[52] U.S. Cl. ..... 399/388; 399/381

[58] Field of Search ..... 355/271, 273, 355/274, 277, 308, 309, 297, 310, 311, 316, 361, 381, 388

[56] References Cited

U.S. PATENT DOCUMENTS

| | | |
|---|---|---|
| 4,055,380 | 10/1977 | Borostyan . |
| 5,189,469 | 2/1993 | Endo . |
| 5,237,378 | 8/1993 | McEwen . |
| 5,268,724 | 12/1993 | Koizumi et al. . |
| 5,276,491 | 1/1994 | Fuma et al. . |
| 5,418,604 | 5/1995 | Nagakura et al. . |
| 5,499,086 | 3/1996 | Matsuno et al. . |

*Primary Examiner*—Sandra L. Brase
*Attorney, Agent, or Firm*—Jordan and Hamburg

[57] ABSTRACT

A paper transport mechanism is used in an image forming apparatus in which a toner image formed on a surface of a photosensitive member is transferred by an image transfer voltage generated by an image transfer unit onto paper which has been fed from a paper storage up to the photosensitive member through a paper path. The paper transport mechanism is provided with a first roller having a width not smaller than a maximum width of the paper stored in the paper storage, a group of second rollers aligned along the first roller for gripping the paper therebetween and transporting it toward the photosensitive member, each of the second rollers having a small width, and a non-undulation guide member provided immediately upstream of the first and second rollers for pressing the paper passing through the paper path against the first roller, the non-undulation guide member having a width not smaller than the maximum paper width. The paper fed from the paper storage is pressed against the first roller across the full paper width before the first and second rollers grip the paper. The paper is transported toward the photosensitive member without taking a wavy form so that the whole area of the paper comes into close contact with the photosensitive member. This helps prevent print image dropouts which may otherwise occur in a toner image transfer process.

11 Claims, 6 Drawing Sheets

PAPER TRANSPORT MECHANISM FOR USE IN AN IMAGE FORMING APPARATUS

BACKGROUND OF THE INVENTION

This invention relates to a paper transport mechanism for use in an image forming apparatus which can feed paper to a photosensitive drum without causing the paper to take a wavy form.

In a conventionally known image forming apparatus, a toner image formed by a toner image forming assembly comprising a photosensitive drum is transferred onto paper which has been fed from a paper tray up to the photosensitive drum. After the toner image has been fixed on the paper by a fixing unit, the paper is outputted from the apparatus. The conventional image forming apparatus generally comprises a pair, or pairs, of pre-transfer stage rollers provided on the upstream side of the photosensitive drum, each pair including a driving roller and an idle roller, for properly transporting the paper to the photosensitive drum.

FIG. 4 is a diagram illustrating a construction of a photosensitive drum 10 and its surrounding components of a conventional image forming apparatus while FIG. 5 is a diagram illustrating pairs of pre-transfer stage rollers 103 as seen from the upstream side of a paper path.

Referring to FIG. 4, the photosensitive drum 10 is positively charged by a static charger 11 at first and an electrostatic latent image is produced in a particular surface area of the photosensitive drum 10 through an exposure process. Next, a toner image is developed as negatively charged toner powder supplied from a developing unit 12 is deposited onto the aforesaid surface area of the photosensitive drum 10, and a discharge lamp 13 eliminates electrostatic charges remaining in unwanted surface areas of the photosensitive drum 10. While the toner image is being developed on the photosensitive drum 10, paper which has been transferred by a pair of registration rollers (not shown) through a paper path formed by paper guides 106 and 107, for instance, is guided by the pre-transfer stage rollers 103 into a slot between an outer guide 104 and an inner guide 105. As the paper reaches the surface of the photosensitive drum 10, a positively charged image transfer unit 14 causes the toner image to be transferred onto the paper. The paper is then separated from the surface of the photosensitive drum 10 by a paper separating unit 15 including an alternating current (AC) power source and further transported to a fixing unit (not shown) along a paper guide 27.

The pre-transfer stage rollers 103 generally include a plurality of driving rollers 101 and idle rollers 102 as shown in FIG. 5, each roller having a small width for the sake of cost reduction. Aligned at right angles to the paper path in a comblike configuration, these small-sized driving rollers 101 and idle rollers 102 grip the paper P at particular space intervals while feeding it.

A major problem of this type of paper transport mechanism is that the paper P becomes undulated widthwise as shown in FIG. 6 while it is being transported. This is because the pre-transfer stage rollers 103 hold the paper P just at particular positions along its width. This problem occurs most often when using paper having a large width or tracing paper which is susceptible to the influence of humidity.

A previous approach to cope with this problem is to direct the right-hand and left-hand idle rollers 102 obliquely outward with respect to the paper feeding direction so that they would symmetrically fan out downstream. With this arrangement, the paper is stretched widthwise while it is being transported to prevent its undulation. However, if the pre-transfer stage rollers 103 grip the leading edge of the paper in a wavy form, undulation in its leading edge portion cannot be eliminated although the paper will be straightened in its trailing edge portion.

If the paper is transported up to the pre-transfer stage rollers 103 in a wavy form, some portions of the paper will not come into contact with the surface of the photosensitive drum 10. This would result in an inability to transfer the complete toner image onto the paper, leaving partial dropouts on a final output.

SUMMARY OF THE INVENTION

It is an object of the present invention to provide a paper transport mechanism for use in an image forming apparatus which has overcome the problem residing in the prior art.

It is another object of the present invention to provide a paper transport mechanism for use in an image forming apparatus which can properly feed paper to a photosensitive drum without causing undulation of the paper.

According to the invention, a paper transport mechanism for use in an image forming apparatus in which a toner image formed on a surface of a photosensitive member is transferred by an image transfer voltage generated by an image transfer unit onto paper which has been fed from a paper storage up to the photosensitive member through a paper path, the mechanism comprises a first roller having a width not smaller than a maximum width of the paper stored in the paper storage; a group of second rollers aligned along the first roller for gripping the paper therebetween and transporting it toward the photosensitive member, each of the second rollers having a small width; and a non-undulation guide member provided immediately upstream of the first and second rollers for pressing the paper passing through the paper path against the first roller, the non-undulation guide member having a width not smaller than the maximum width of the paper.

In the paper transport mechanism, the paper fed from the paper storage is pressed against the first roller by the non-undulation guide member across the full paper width before the paper is gripped by the first and second rollers. The paper can therefore be transported toward the photosensitive member without taking a wavy form so that the whole area of the paper comes into close contact with the photosensitive member. This arrangement helps prevent print image dropouts which may otherwise occur when the toner image is transferred from the surface of the photosensitive member onto the paper at the image transfer unit.

The non-undulation guide member may be formed with an electrically conductive material and electrically connected to a grounding terminal provided on a main body of the image forming apparatus.

Although static electricity arises due to friction between the paper and the non-undulation guide member, resultant electric charges are discharged through the grounding terminal provided on the main body of the image forming apparatus since the non-undulation guide member is formed with an electrically conductive material and electrically connected to the grounding terminal. This arrangement effectively prevents accumulation of electric charges on the non-undulation guide member.

Also, it may be appreciated that a voltage-dependent resistor whose resistance drops when a voltage applied thereto exceeds a predetermined voltage level is connected between the non-undulation guide member and grounding terminal, and the predetermined voltage level is higher than a voltage across the voltage-dependent resistor when the image transfer voltage is applied by way of the paper.

According to this arrangement, the image transfer voltage does not cause the voltage-dependent resistor to conduct so that the provision of the voltage-dependent resistor does not affect a toner image transfer process. When the voltage caused by static electricity due to friction between the paper and the non-undulation guide member exceeds the predetermined level, the resistance of the voltage-dependent resistor drops, allowing electric charges accumulated on the non-undulation guide member to discharge through the grounding terminal. This arrangement also prevents accumulation of electric charges on the non-undulation guide member.

Further, the non-undulation guide member may be a filmlike plastic element having a specified level of resilience.

Although the non-undulation guide member is remarkably simple in its mechanical construction, the paper can be smoothly transported toward the photosensitive member without taking a wavy form.

These and other objects, features and advantages of the invention will become more apparent upon reading the following detailed description of a preferred embodiment, which are illustrated in drawings.

DETAILED DESCRIPTION OF THE PREFERRED EMBODIMENT OF THE INVENTION

Figure 1:
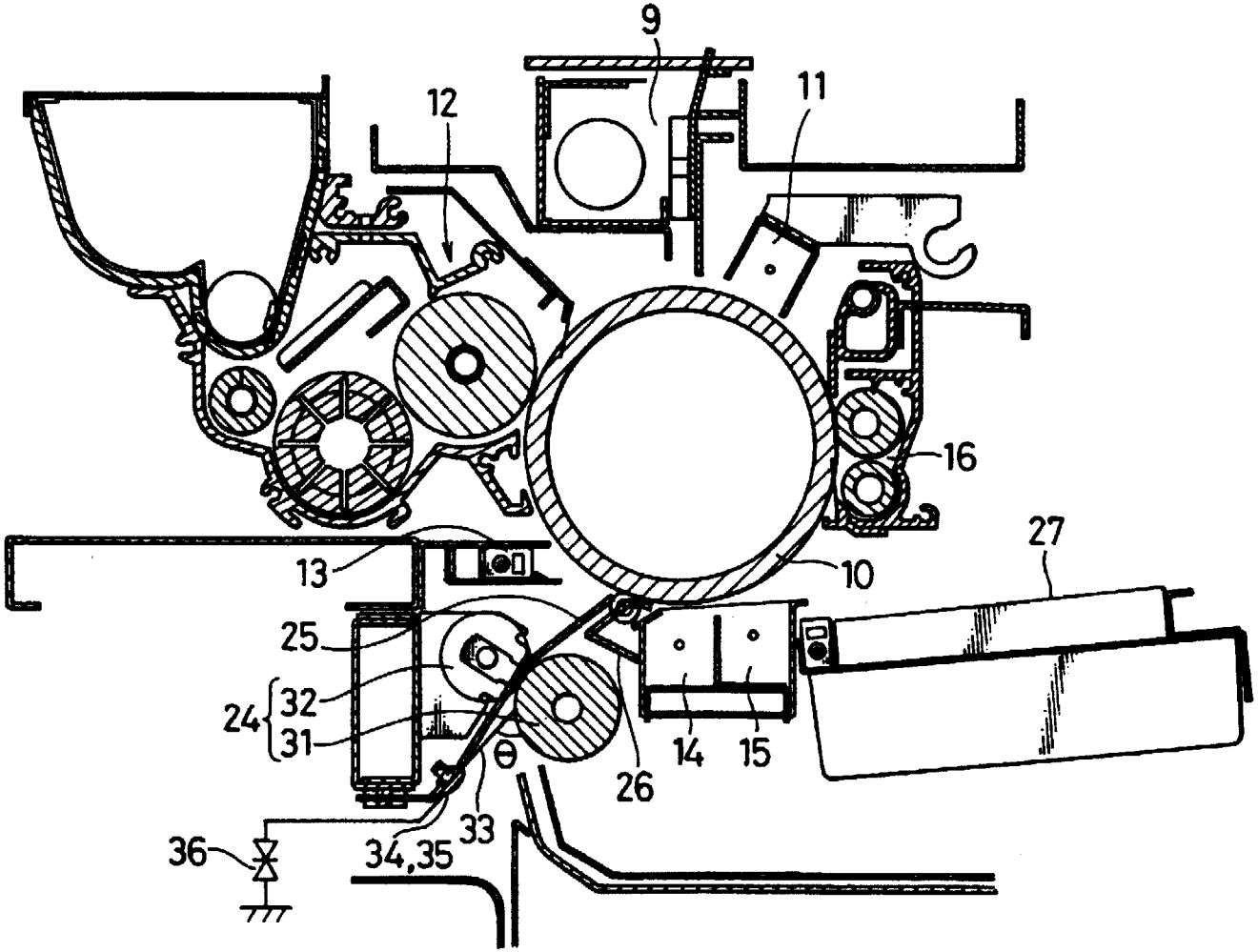
FIG. 1 is a diagram showing a construction of a photosensitive drum and its surrounding components of an image forming apparatus incorporating a paper transport mechanism embodying the invention.
Figure 2:
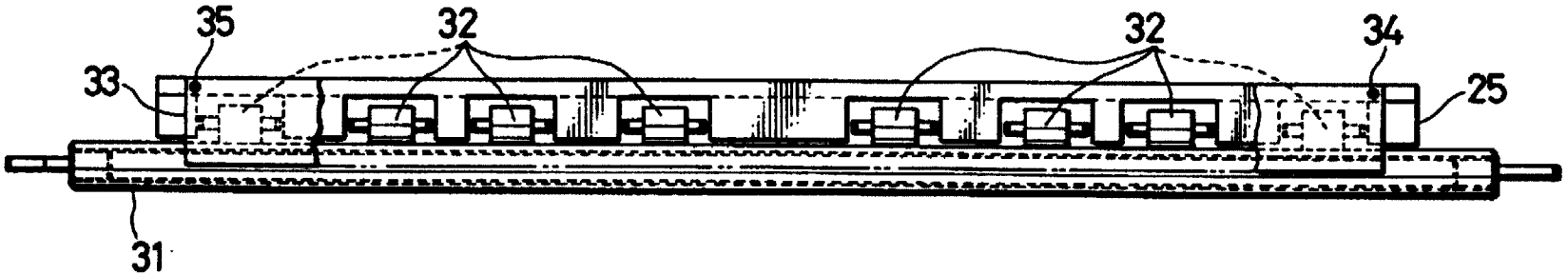
FIG. 2 is a diagram showing pre-transfer stage rollers and a non-undulation guide member.
Figure 3:
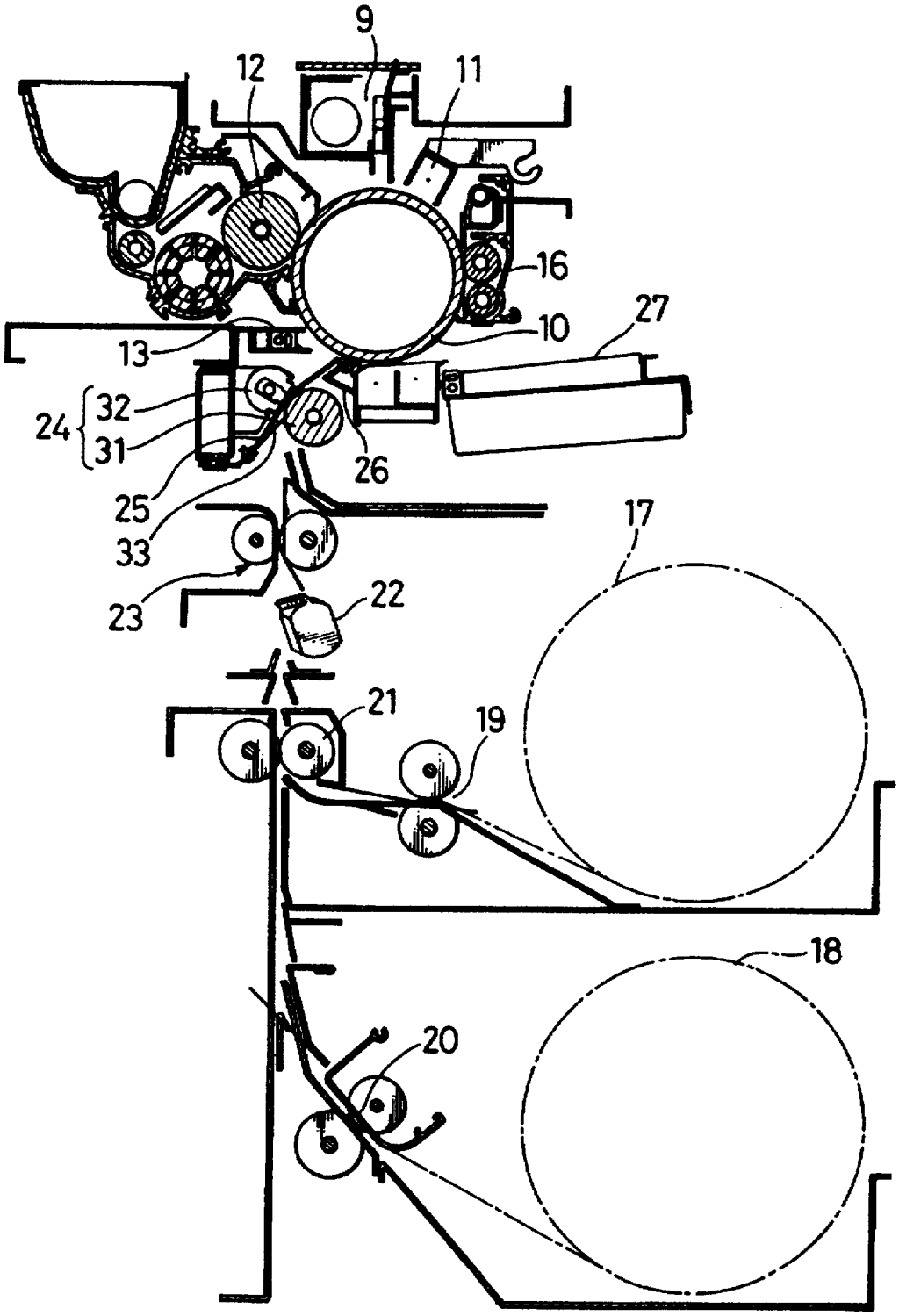
FIG. 3 is a diagram showing a general internal construction of the image forming apparatus.
Figure 4:
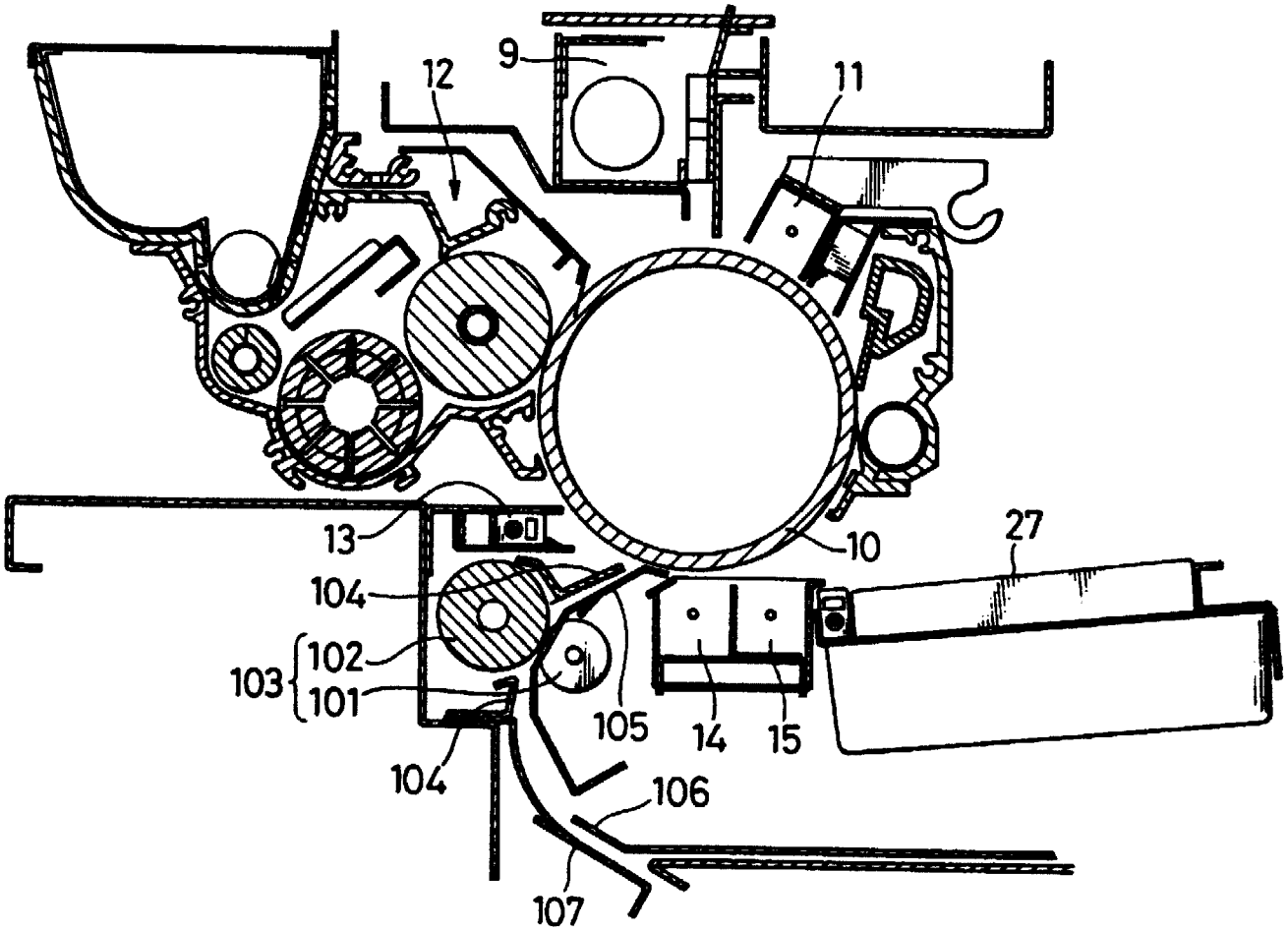
PRIOR ART FIG. 4
FIG. 4 is a diagram showing a construction of a photosensitive drum and its surrounding components of a conventional image forming apparatus.
Figure 5:
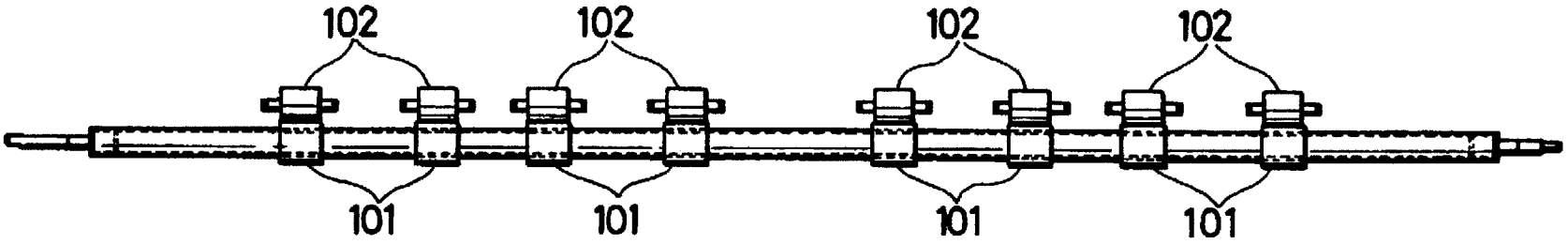
PRIOR ART FIG. 5
FIG. 5 is a diagram showing pairs of pre-transfer stage rollers of the conventional image forming apparatus.
Figure 6:
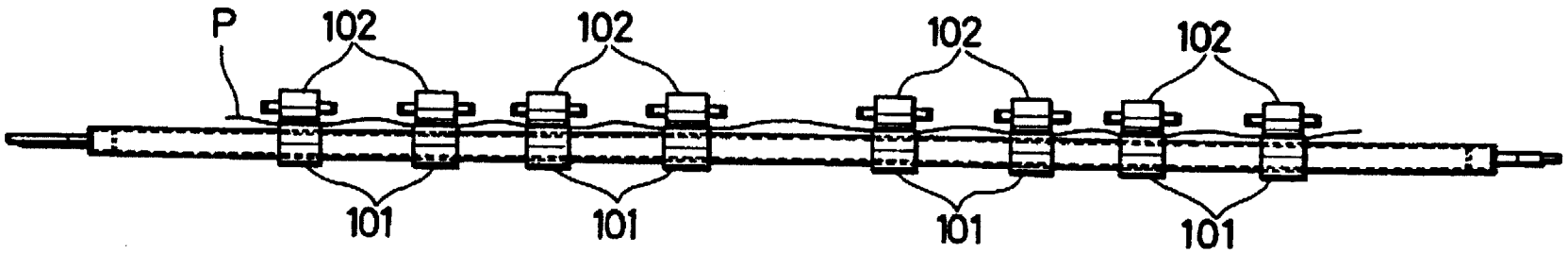
PRIOR ART FIG. 6
FIG. 6 is a diagram showing a situation in which paper transferred by the pairs of pre-transfer stage rollers of FIG. 5 is taking a wavy form.

The present invention will now be described in detail as being embodied in an image forming apparatus with reference to the attached drawings, in which like reference numerals designate like elements. FIG. 1 is a diagram showing a construction of a photosensitive drum 10 and its surrounding components according to a preferred embodiment, FIG. 2 is a diagram showing pre-transfer stage rollers 24 of the image forming apparatus of FIG. 1 as seen from the upstream side, and FIG. 3 is a diagram depicting a general internal construction of the image forming apparatus.

Elements constituting image forming and paper transport systems of the image forming apparatus are contained in its main body.

The image forming system of the image forming apparatus comprises the photosensitive drum 10 and its surrounding components, which include a static charger 11 for charging the photosensitive drum 10 to a specified positive voltage, an exposure unit 9 for producing an electrostatic latent image on the photosensitive drum 10 by exposing its specified surface area to light rays, a developing unit 12 for negatively charging toner powder and developing a toner image by depositing the toner powder onto the latent image, a discharge lamp 13 for eliminating electrostatic charges remaining in unwanted surface areas of the photosensitive drum 10, an image transfer unit 14 including a direct current (DC) power source of a few kilovolts for transferring the toner image onto paper, a paper separating unit 15 including an AC power source for separating the paper from the surface of the photosensitive drum 10, and a cleaning unit 16 for removing toner powder remaining on the surface of the photosensitive drum 10 after an image transfer process.

The paper transport system comprises, from the upstream side, a wide-sized roll paper 17 which allows printing on the A1 size in portrait format or on the A2 size in landscape format, a yet wider roll paper 18 which allows printing on the A0 size in portrait format or on the A1 size in landscape format, pairs of paper feeding rollers 19, 20 and 21 for feeding paper, a cutter 22 for cutting the roll paper 17 or 18 into a specified size, a pair of registration rollers 23 for feeding a cut sheet of paper in precise synchronism with an image development process, the pre-transfer stage rollers 24 which will be described later, as well as a pre-transfer stage outer guide 25 and pre-transfer stage inner guide 26 which form together a paper path for guiding the paper up to the photosensitive drum 10. The paper transport system further comprises in its downstream side a paper guide 27 for transporting the paper that carries the transferred toner image to a fixing unit (not shown).

The pre-transfer stage rollers 24 include a driving roller 31 which is driven by an unillustrated drive mechanism and a plurality of idle rollers 32 which are pressed against the driving roller 31 to rotate together. As shown in FIG. 2, the driving roller 31 has a width equal to or greater than widths of paper stored in paper bins. The individual idle rollers 32 are small in width and aligned at right angles to the paper path. The right-hand and left-hand groups of the idle rollers 32 are directed obliquely outward with respect to the paper feeding direction.

A non-undulation guide member 33 is fixed to the pre-transfer stage outer guide 25 with screws 34 and 35. The non-undulation guide member 33 of this embodiment is a strip of plastic film containing polyethylene terephthalate, for instance. The non-undulation guide member 33 has a width not less than the maximum paper width applicable, that is, the extent of the short side of the A0 size in this embodiment. As the non-undulation guide member 33 is screwed to the pre-transfer stage outer guide 25, the forward edge of the non-undulation guide member 33 is forced against the driving roller 31 with its own resilient force so that the forward edge of the non-undulation guide member 33 is kept in contact with the round surface of the driving roller 31 at an acute angle q. The non-undulation guide member 33 has electrical conductivity because its plastic film material contains an electrically conductive substance.

The screws 34 and 35 are connected to a grounding terminal provided on the main body of the image forming apparatus via a varistor 36. The varistor 36 is a voltage-dependent resistor whose resistance sharply drops when an applied voltage exceeds a specific varistor voltage. The varistor 36 used in this embodiment has a varistor voltage of a few hundred volts, for instance.

In the image forming apparatus thus constructed, the static charger 11 positively charges the cylindrical surface of the photosensitive drum 10 and the exposure unit 9 exposes a specified surface area of the photosensitive drum 10 to create an electrostatic latent image. Then, a toner image is developed on the photosensitive drum 10 as negatively charged toner powder supplied from the developing unit 12 sticks to the latent image area.

On the other hand, the roll paper 17 or 18 fed by the paper feeding rollers 19 or 20 is supplied by the paper feeding rollers 21 and cut to a specified size by the cutter 22. The cut sheet of paper is transported by the registration rollers 23 in synchronism with the image development process. As the paper enters and passes through the pre-transfer stage rollers 24, the non-undulation guide member 33 pushes the paper against the driving roller 31 from side to side, and from the leading edge to the trailing edge. As a result, the paper is guided to the surface of the photosensitive drum 10 without warpage or undulation so that the whole area of the paper comes into close contact with the surface of the photosensitive drum 10 and the image transfer unit 14 transfers the toner image onto the paper. The paper is then peeled off the surface of the photosensitive drum 10 by the paper separating unit 15 and further transported along the paper guide 27 to the fixing unit (not shown), which fixes the toner image to the paper.

Since the non-undulation guide member 33 uniformly pushes the paper across its full width against the driving roller 31, the paper is transported to the surface of the photosensitive drum 10 without waving and the whole area of the paper comes into close contact with the photosensitive drum 10. This provides a high-quality final output free from partial dropouts of a printed image.

As seen above, the non-undulation guide member 33 is kept in contact with the paper while the pre-transfer stage rollers 24 feed the paper toward the photosensitive drum 10. It will be recognized that static electricity can develop due to friction between the paper and the non-undulation guide member 33, causing electric charges to accumulate on the non-undulation guide member 33. As already mentioned, however, the non-undulation guide member 33 is made of an electrically conductive material and connected to the grounding terminal provided on the main body of the image forming apparatus so that electric charges that may accumulate on the non-undulation guide member 33 are discharged. This arrangement serves to prevent problems resulting from static electricity.

Without the above-described anti-static measure, an operator who accidentally touches the non-undulation guide member 33 when attempting to remove a paper jam, for example, would suffer electrical shock hazards as the electric charge accumulated on the non-undulation guide member 33 is discharged through the body of the operator. Furthermore, if the non-undulation guide member 33 is charged, the paper may stick to the non-undulation guide member 33, causing a paper feeding problem. Moreover, electric charges accumulated on the non-undulation guide member 33 may be carried by the paper and adversely affect the voltage applied to the image transfer unit 14 for transferring the toner image onto the paper. The foregoing anti-static measure effectively prevents the problems associated with static electricity.

If the electrically conductive non-undulation guide member 33 is directly connected to the grounding terminal, electric charges accumulated on the image transfer unit 14 may discharge through the paper and the grounding terminal and the voltage applied to the image transfer unit 14 may drop, resulting in an improper toner image transfer operation. In this embodiment, the non-undulation guide member 33 is connected to the grounding terminal via the varistor 36 so that only that portion of electric charges caused by frictional static electricity is discharged through the grounding terminal.

In normal operating condition, the image transfer unit 14 is charged to a few kilovolts. This voltage declines to a few hundred volts in the vicinity of the non-undulation guide member 33 as a result of a voltage drop along the length of the paper. On the other hand, the voltage caused by static electricity due to friction between the paper and the non-undulation guide member 33 is usually higher than a few hundred volts and occasionally exceeds 1 kilovolts. The varistor voltage is set between these voltage values so that the voltage applied to the image transfer unit 14 does not cause the varistor 36 to conduct. As a result, only such electric charges caused by frictional static electricity are discharged through the varistor 36. With this arrangement, the image transfer unit 14 can properly transfer the toner image onto the paper.

Although the non-undulation guide member 33 is fixed at only one edge by the screws 34 and 35 in the above embodiment, the non-undulation guide member 33 may be curled into a U-shaped cross section and screwed at both edges. In this varied form of the embodiment, a bulging or protruding portion of the U-shaped cross section is kept in contact with the driving roller 31 along the width of the non-undulation guide member 33. A resilient force exerted when the plastic film material is curled will cause the non-undulation guide member 33 to press against the driving roller 31, producing substantially the same effect as the foregoing preferred embodiment.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A paper transport mechanism for use in an image forming apparatus in which a toner image formed on a surface of a photosensitive member is transferred by an image transfer voltage generated by an image transfer unit onto paper which has been fed from a paper storage up to the photosensitive member through a paper path, the paper transport mechanism comprising:

a first roller having a width not smaller than a maximum width of the paper stored in the paper storage;

a group of second rollers aligned along the first roller for gripping the paper therebetween and transporting it toward the photosensitive member, each of the second rollers having a small width;

a non-undulation guide member provided immediately upstream of the first and second rollers for pressing the paper passing through the paper path against the first roller, the non-undulation guide member having a width not smaller than the maximum width of the paper;

said non-undulation guide member being formed with an electrically conductive material and being electrically connected to a grounding terminal provided on a main body of the image forming apparatus; and a voltage-dependent resistor whose resistance drops when a voltage applied thereto exceeds a predetermined voltage level connected between the non-undulation guide member and grounding terminal, and wherein the predetermined voltage level is higher than a voltage across the voltage-dependent resistor when the image transfer voltage is applied by way of the paper.

2. A paper transport mechanism for use in an image forming apparatus in which a toner image formed on a surface of a photosensitive member is transferred by an image transfer voltage generated by an image transfer unit onto paper which has been fed from a paper storage up to the photosensitive member through a paper path, the paper transport mechanism comprising:

a first roller having a width not smaller than a maximum width of the paper stored in the paper storage;

a group of second rollers aligned along the first roller for gripping the paper therebetween and transporting it toward the photosensitive member, each of the second rollers having a small width;

a pair of guide plates disposed immediately upstream of the photosensitive member in the paper path; and a non-undulation guide member provided immediately upstream of the first and second rollers for pressing the paper passing through the paper path against the first roller, the non-undulation guide member having a width not smaller than the maximum width of the paper.

3. A paper transport mechanism for transporting paper along a paper path comprising:

a first roller means and a second roller means aligned along the first roller means for gripping the paper therebetween and transporting the paper along the paper path, and a non-undulation guide member disposed upstream of the first and second roller means for resiliently pressing the paper passing along the paper path unto resilient contact with the first roller means to thereby facilitate transporting said paper in a non-undulating form.

4. A paper transport mechanism as defined in claim 3 wherein said non-undulating guide member is made of a resilient material and the resiliency of the non-undulating material is operable to cause the non-undulating member to resiliently press the paper passing through the paper path into contact with the first roller means.

5. A paper transport mechanism as defined in claim 4 wherein said non-undulating member has a forward edge which is maintained in resilient contact with said first roller means and maintained in resilient contact with the paper passing about said first roller means.

6. A paper transport mechanism as defined in claim 5 further comprising a stationary support structure upstream of said first and second roller means, said non-undulating member having a rear end portion, and fastening means fastening said rear end portion of said non-undulating member to said stationary support structure.

7. A paper transport mechanism as defined in claim 3 wherein said non-undulating member is disposed non-tangential to said first roller means.

8. A paper transport mechanism as defined in claim 3 wherein said first and second roller means form a nip at which the first and second roller means engage the paper, said non-undulating guide member having a forward edge which contacts said first roller means at a contact location disposed upstream of said nip.

9. A paper transport mechanism as defined in claim 8 wherein said non-undulating member is disposed at an acute angle relative to a tangential line which extends tangentially from said first roller means at a point where said forward edge of said non-undulating member contacts said first roller means.

10. A paper transport mechanism as defined in claim 3 wherein said non-undulating guide member comprises a strip of plastic film.

11. A paper transport mechanism as defined in claim 10 wherein said plastic film includes an electrically conductive substance.

* * * * *